United States Patent [19]

Tanaka et al.

[11] 4,392,813

[45] Jul. 12, 1983

[54] COMBUSTION APPLIANCE WITH SAFETY DEVICE

[75] Inventors: Eiichi Tanaka, Yamatokoriyama; Noboru Ishibasi, Nabari; Shojiro Inoue, Nara, all of Japan

[73] Assignee: Matsushita Electric Industrial Co., Ltd., Kadoma, Japan

[21] Appl. No.: 179,874

[22] Filed: Aug. 20, 1980

[30] Foreign Application Priority Data

Aug. 20, 1979 [JP] Japan ..... 54-106343

[51] Int. Cl.[3] ..... F23N 5/00

[52] U.S. Cl. ..... 431/76; 431/33; 431/201; 73/27 R

[58] Field of Search ..... 431/75, 76, 195–201, 431/33, 34; 236/15 E; 126/91 R, 92 R, 92 AC; 73/23, 27 R; 200/61.03; 338/34; 204/195 S, 1 T; 340/577, 579

[56] References Cited

U.S. PATENT DOCUMENTS 2,621,721 12/1952 Manteria ..... 431/200
3,672,809 6/1972 Hebard ..... 431/34
4,032,286 6/1977 Kobayashi et al. ..... 431/76
4,234,542 11/1980 Romine ..... 338/34
4,249,156 2/1981 Micheli ..... 338/34

FOREIGN PATENT DOCUMENTS 908973 10/1962 United Kingdom ..... 431/33

*Primary Examiner*—James C. Yeung
*Assistant Examiner*—Lee E. Barrett
*Attorney, Agent, or Firm*—Wenderoth, Lind & Ponack

[57] ABSTRACT

In a combustion appliance with a safety device therein, an inner flame cylinder, a red-heat cylinder and an outer cylinder disposed concentrically on the outer side of the red-heat cylinder are provided to constitute a combustor and an oxygen sensor is disposed in the rear flow of the combustion flames of the combustor and in a position where the air excess ratio of the flames can be detected. During the incomplete combustion through air feed shortage or the like caused due to dust clogging or the like as well as during the oxygen depression, the oxygen sensor can detect changes in the flames or changes in the red-heat condition of the red-heat cylinder to stop the burning operation thereby to secure the safety.

5 Claims, 7 Drawing Figures

COMBUSTION APPLIANCE WITH SAFETY DEVICE

The present invention relates to a combustion appliance with a safety device therein, wherein a combustor for perfect secondary air combustion, which has an inner flame cylinder, a red-heat cylinder and an outer cylinder concentrically disposed on the other side of the red-heat cylinder, is adapted to stop the fuel feed to the combustor, not only during the oxygen depression caused by decreased oxygen concentration in the combustion air, but also before clogging of the appliance-air-feed-ports with dust, can cause incomplete combustion resulting in the creation of poisonous carbon monoxide.

Conventionally, as a safety device for a combustion appliance, there was a flame failure device for preventing the crude gas from flowing out, an oxygen-depression safety device for detecting the decreased oxygen concentration in the combustion air and an earthquake-proof automatic extinguisher or the like. As the flame failure safety device, a means for detecting the existence of the flames of a pilot with a thermocouple is normally used. There has been proposed an oxygen-depression safety device or the like, which detects, as a change in flame temperature, the reduction of the oxygen before carbon monoxide is produced from a main burner when the oxygen concentration in the combustion air has been lowered, through improved detecting means or various shapes of burner construction (Japanese Laid Open Patent Application (Tokkaisho) No. 51725/1976). However, even if, in the case of such devices as described hereinabove, the oxygen concentration in the combustion air decreases to narrow the combustion range of the burner and to prevent carbon monoxide from being produced, the devices cannot cope with the appliance parts or the burner ports clogged with dust or the like after a longer period of use. For instance, a stove or the like placed on the floor is likely to suffer the influences of dust, while stoves or the like placed on carpet never fail to experience dust clogging. Thus, a combustor for perfect secondary air combustion, which is improved to have hardly any air-cloggings, is normally used. However, even in this system, the air feed ports for the secondary air are clogged by dust in the secondary air, thus resulting in probable oxygen depression. The conventional pilot burner for detecting oxygen depression to be combined with the combustor cannot become a complete safety device, since the pilot burner is provided only to detect the oxygen concentration of the air for the burning operation for the oxygen-depression detecting pilot burner, instead of detecting the oxygen depression through operative cooperation with the main burner.

Conventionally, among the petroleum combustor appliances, earthquake-proof extinguishers which detect vibrations to extinguish the flames are employed in practical use. However, no oxygen-depression safety devices are provided thereto, and such a oxygen-depression detecting pilot burner as described hereinabove cannot be provided additionally.

OBJECTS AND SUMMARY OF THE INVENTION

An object of the present invention is to provide a combustion appliance, with a safety device therein, of such characteristics that it can eliminate the disadvantages inherent to the above described conventional devices.

Another object of the present invention is to provide a combustion appliance with a safety device which can detect without failure abnormal flames to cut off the supply of the fuel such as gas or petroleum before carbon monoxide is produced by incomplete combustion caused by depressed oxygen concentration in the air or reduction in the amount of air required for combustion.

A further object of the present invention is to provide a combustion appliance with a safety device which is simple in construction, easy to assemble, functions accurately and may be manufactured at low cost.

According to the present invention, a combustion appliance comprises a red-heat cylinder of wire gauze, punching plate, lath wire, etc. provided on the outer side of an inner flame cylinder housing a plurality of small holes therein, an outer cylinder provided on the outer side of the red-heat cylinder and inner flame cylinder, a fuel supplying means provided between the inner flame cylinder and the red-heat cylinder, an oxygen sensor disposed in the combustion flame rear flow in a position where the air excess ratio of the flames can be detected, and a means for cutting off the fuel feed, which is operated by the output of the oxygen sensor. When the reduction in the oxygen concentration of the air or the reduction in the amount of air for combustion has caused incomplete combustion, the oxygen sensor detects changes in the frames or changes in the red heat condition of the red-heat cylinder and causes the burning iperation to stop, whereby the combustion is stopped to ensure the safety.

BRIEF DESCRIPTION OF THE DRAWINGS

These and other objects, features, aspects and advantages of the present invention will become more apparent from the following detailed description of the present invention when taken in conjunction with the accompanying drawings, in which.

Before the description of the present invention proceeds, it is to be noted here that like parts are designated by like reference numerals throughout several views of the accompanying drawings.

DETAILED DESCRIPTION OF THE PREFERRED EMBODIMENTS

Figure 1:
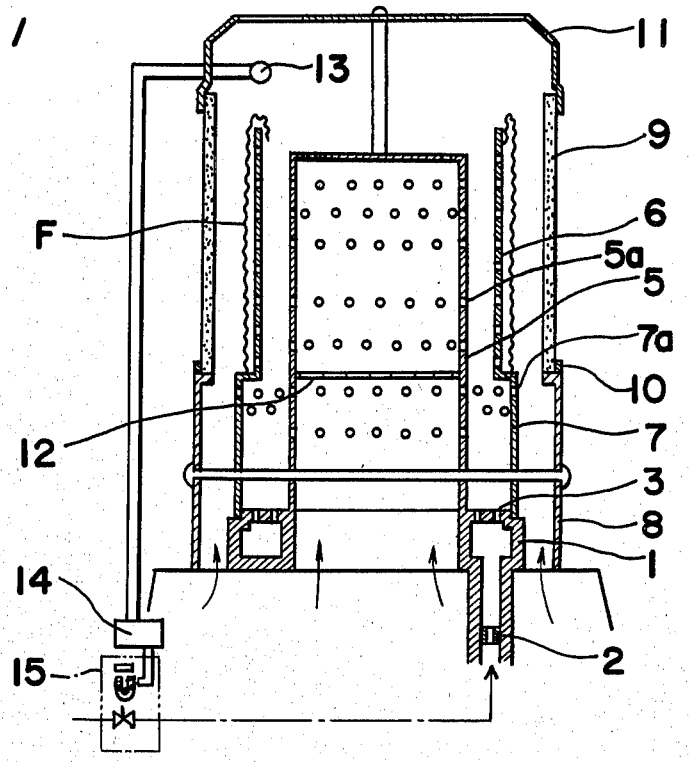
FIG. 1 is a cross-sectional view of a combustion appliance with a safety device in accordance with one embodiment of the present invention.

Referring to FIG. 1, showing one embodiment of the present invention applied to a gas stove of cylindrical type, there is provided a burner 1 of ring shape in connection with a nozzle 2 through which gas only enters the burner 1 and a burner flame hole 3 through which gas is jetted from the burner 1 to a space disposed between a pair of cylinders 5 and 7. An inner flame cylinder 5 with many small holes 5*a* therein is provided on the inner periphery of the burner 1, and an outer flame cylinder 7 with many small holes 7*a* therein is provided on the outer side of the burner 1, the inner flame cylinder having a cover at its top end while the outer flame cylinder is connected with a red-heat cylinder 6 composed of wire gauze, punching plate, lath wire, etc. on its outer periphery. A heat screening cylinder 8 is disposed on the outer side of the outer flame cylinder 7, while an outer cylinder 9 made of heat-resisting glass is provided on the outer side of the red-heat cylinder 6, the outer cylinder 9 being connected to the heat screening cylinder 8 with a glass-securing metal fixture 10. An outer cylinder cap 11 is mounted on the top end of the outer cylinder 9 to serve as a fixing means for the outer cylinder 9 and to provide therein a closed combustion chamber together with the outer cylinder 9. An air-inlet perforated plate 12 is provided within the upper portion of the inner flame cylinder 5 so that air can flow therethrough to protect the inner flame cylinder 5 from the thermal radiation generated from the red heating of the inner flame cylinder 5. An oxygen sensor 13 is provided within the combustion chamber under the outer cylinder cap 11 to detect the air excess ratio of the flame F at the red-heat cylinder 6. The output of the oxygen sensor is input to the electronic circuit 14, which controls a solenoid valve 15 for adjusting the amount of fuel-gas mixture to be supplied to the nozzle 2.

The oxygen sensor 13 used in the present invention, which is composed of a transition metal oxide such as $TiO_2$, $V_2O_5$, $Cr_2O_3$, $SnO_2$, $Fe_2O_3$, NiO or CoO, a rare earth metal oxide such as $CeO_2$, $Pr_6O_{11}$ or the like, and a sintered ceramic body such as tin oxide or the like, is equipped with a pair of spaced electrodes. The resistance value between the electrodes of the oxygen sensor 13 varies in accordance with variation in the air/fuel ratio which is detected as the partial oxygen pressure in the gas to be detected at high temperatures between 600° C. and 900° C.

Also, there is an oxygen concentration cell or the like to be used for the oxygen sensor 13, which is composed of an oxygen ion conductive solid electrolyte at a high temperature, such as zirconium oxide or the like, which detects the difference of the partial oxygen pressures to generate electromotive force.

The operation of the combustion appliance with a safety device will be described hereinafter.

Figure 2:
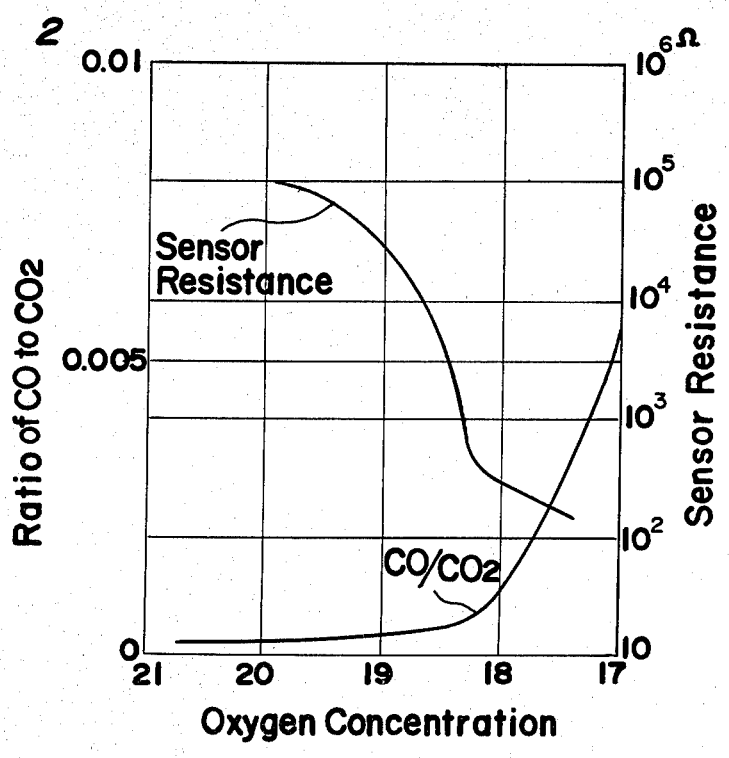
FIG. 2 is a graph showing an oxygen depression characteristic of the apparatus of FIG. 3.

The gas jetted from the burner 1 into the space is ignited and burned through introduction of combustion-required-air through the small ports in the inner flame cylinder 5 and the outer flame cylinder 7 from the atmosphere into the space thereby to form the flames F within the space. Such flames F formed within the space gradually increase the temperature of the oxygen sensor 13, which, as mentioned above, can be a partial oxygen pressure sensor comprising $TiO_2$ or the like provided above the red-heat cylinder 6, so that the resistance value to be detected by the oxygen sensor 13 becomes several tens of KΩ through several hundreds of KΩ, while the oxygen sensor resistance-value becomes several tens of MΩ when extinguishing the flames, to indicate the stable burning condition. Complete combustion is performed normally under such a condition as described hereinabove, but cases where incomplete combustion occures will now be described with reference to FIGS. 2 and 3. Assume that the combustion is performed for many hours in a room or the like where the ventilation is inferior, and the air in the room is reduced due to the increasing amount of combustion exhaust gas, thus resulting in lower oxygen concentration in the air and flames of greater length. At this time, the resistance of the oxygen sensor is reduced to several hundreds of Ω through several KΩ to indicate the incomplete combustion. FIG. 2 shows the relationship between the data of the CO rising in comparison with the amount of $CO_2$ and the resistance variation of the oxygen sensor 13 with respect to the oxygen concentration in the air. If the cut-off for the solenoid valve 15 is adapted to be performed at a proper detection level of the oxygen sensor such as 1KΩ, then safety for the oxygen concentration can be provided before a large amount of CO is produced in the room.

Figure 3:
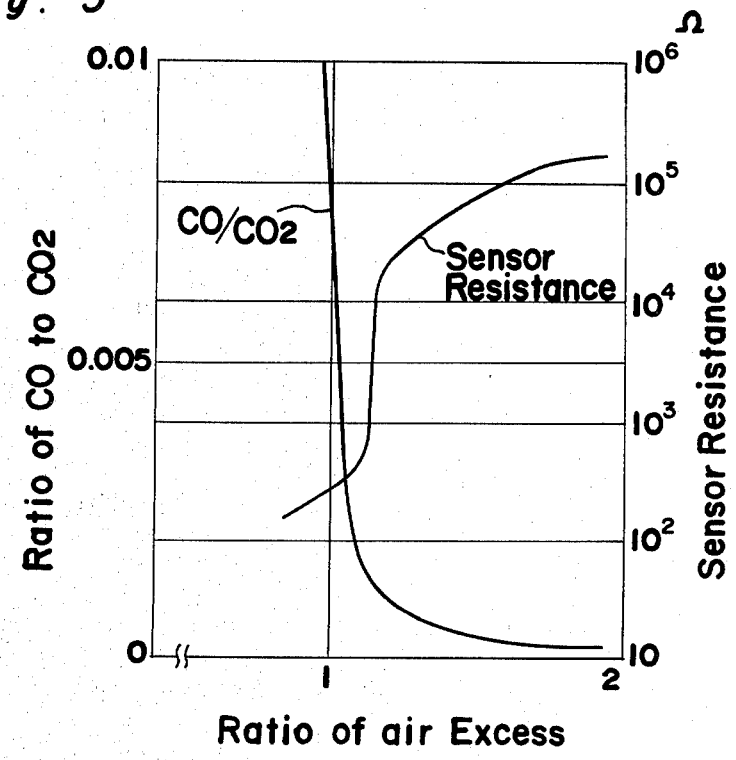
FIG. 3 is a graph showing a sensor characteristic thereof.
Figure 4:
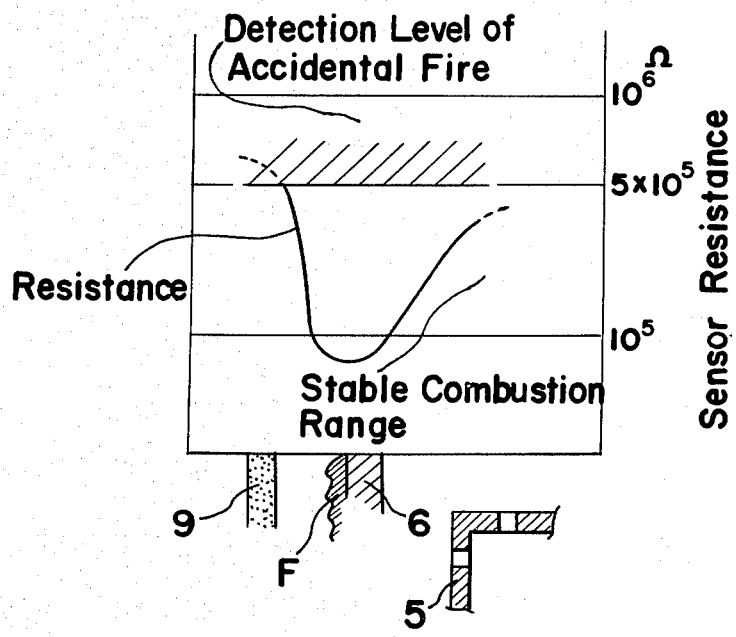
FIG. 4 is a graph showing a sensor position characteristic thereof.

A case where the amount of air to be fed to the burner has been occasionally restricted due to clogging of the burner air holes 5*a*, 7*a* of the cylinders 5, 7, or the like will be described hereinafter with reference to the data shown in FIG. 3. Namely, the combustion is normally performed at an air excess ratio in the approximate range 1.5 through 2.0 in air excess ratio, and the resistance value of the oxygen sensor 13 at this time is provided from several tens of KΩ to several hundreds of KΩ, indicating a stable combustion zone. However, when parts such as the burner air holes of the appliance are suddenly clogged with dust or the like, the amount of air fed to the burner is reduced, thus steadily reducing the air excess ratio in the combustion of the burner. With the reduction of the air in the burner, the resistance value of the oxygen sensor 13 is lowered to the range of from several hundreds of Ω to several KΩ. As shown in FIG. 3, the incomplete burning condition for the burner is provided before a large amount of CO is generated at an air excess ratio of approximately 1, so that a proper cut-off level for the valve can be set to ensure the safety of the appliance. In a combustor wherein the red-heat cylinder 6 composed of wire gauze, punching plate, lath wire, etc. is provided on the outer side of the inner flame cylinder 5, the latter having a plurality of small holes 5*a* therein, and the cylinder 9, made of a heat-resisting, heat-transmission material, is provided on the outer side of them, the partial oxygen pressure sensor 13 provided above the red-heat cylinder detects such incomplete combustion to be generated within the space disposed between the cylinders 5 and 7 as described hereinabove. However, when the partial oxygen pressure sensor 13 is provided farther from above the red-heat cylinder 6, its resistance value becomes larger, under normal burning conditions, to the extent of the resistance value of the accidental-fire detecting level, as shown in FIG. 4. Accordingly, to detect such incomplete combustion of the appliance without failure, it is necessary to provide the oxygen sensor 13 within the range of lateral width located between the inner flame cylinder 5 and the heat resisting glass cylinder 9 above the red-heat cylinder 6, and, on the other hand, it is very difficult to perform the detection precisely by providing the oxygen sensor 13 on the side out of the above range.

Figure 5:
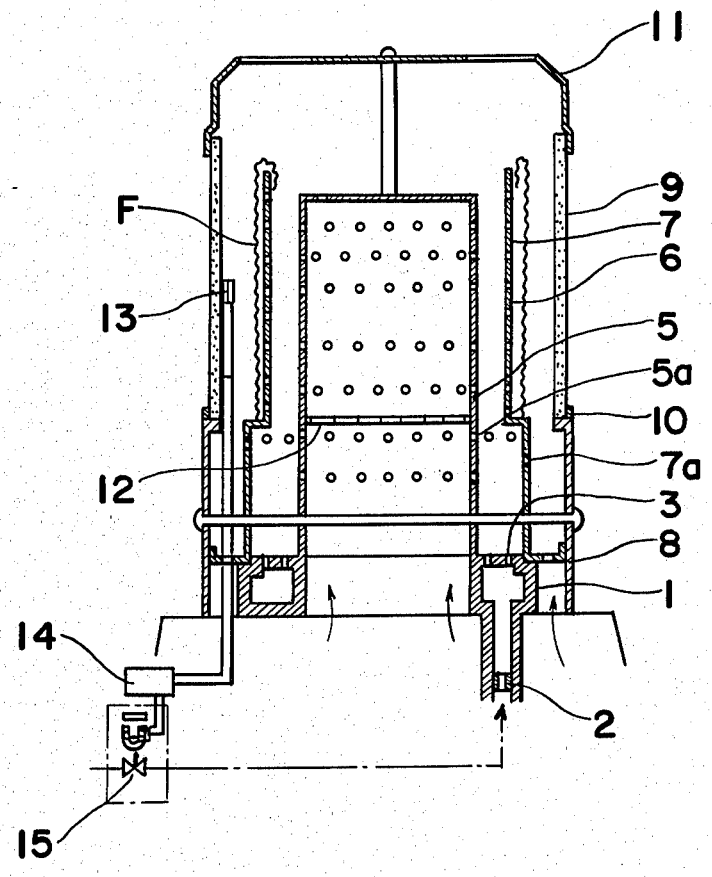
FIG. 5 is a cross-sectional view of a combustion appliance in accordance with another embodiment of the present invention.

As shown in FIG. 5, the oxygen sensor 13 is mounted on the inner side of the heat resisting glass cylinder 9 in the appliance according to another embodiment of the present invention. The oxygen sensor 13 is located between a red-heat cylinder 6 and an outer cylinder 9 of heat resisting glass, and is disposed on the outer side of the red-heat cylinder 6, thereby to detect the air excess ratio of that portion of the flame located at the outer side of the visible flames in the path of flame flow formed of burning exhaust gas including the outer flames in and around the red hot portion (the "rear flow" of the flame flowing from the red-heat cylinder), where the air excess rate varies to a large extent depending on the amount of air available to combust the fuel. The same characteristics to detect the incomplete combustion as shown in FIGS. 2 and 3 are obtained by the appliance of FIG. 5. The oxygen sensor may be provided with a partial oxygen pressure sensor wherein the resistance between a pair of spaced electrodes varies with the change in the partial oxygen pressure to be detected.

The present invention of FIGS. 1 and 5 show an example of the invention applied to a gas combustion appliance. The invention can also be applied to a petroleum combustion appliance. The oxygen sensor must always be positioned where the air excess ratio of the rear flow of the flames to be burned in a red-heat cylinder can be measured with accuracy. The same effects as to the appliances of FIGS. 1 and 5 can be achieved by a petroleum stove or the like in a shape similar to those of FIGS. 1 and 5 except that a heat-resisting glass cylinder is not used.

Figure 6:
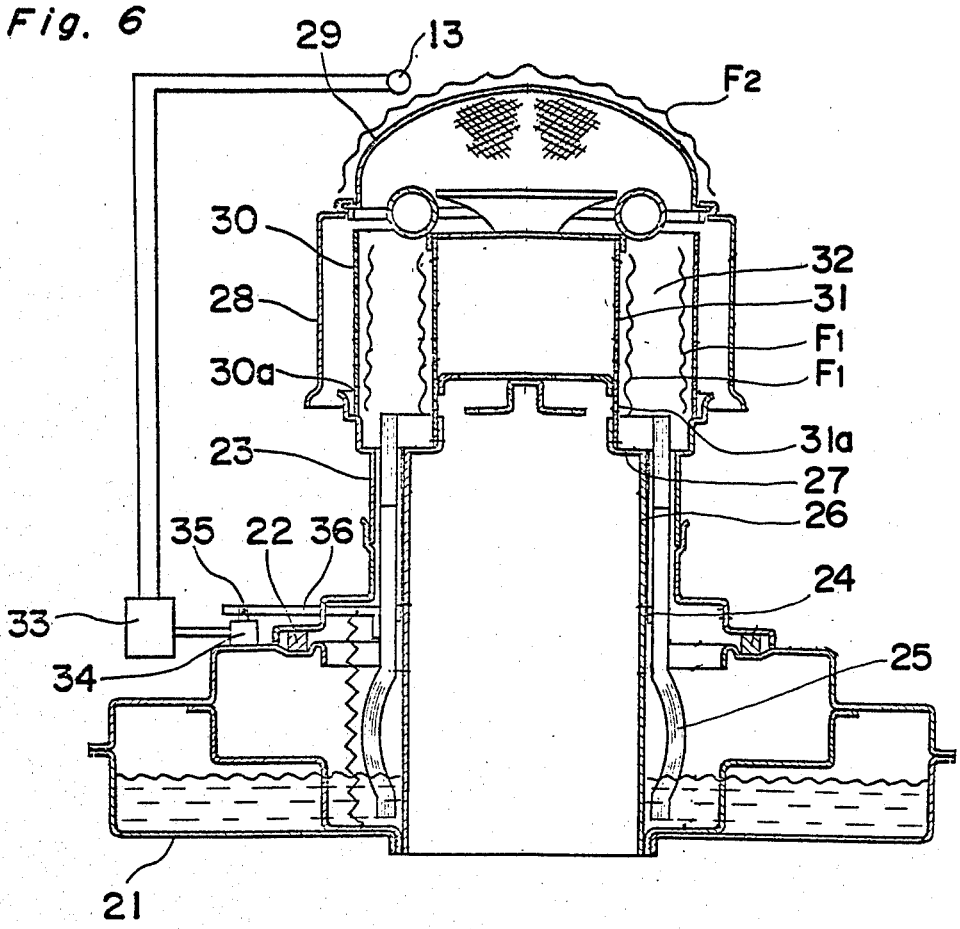
FIG. 6 is a cross-sectional view of a combustion appliance in accordance with a third embodiment of the present invention.

The petroleum stove will be described hereinafter with reference to FIG. 6. A fixed tank 21 stores kerosene therein and a wick outer-cylinder 23 is detachably mounted, through packing 22, on the fixed tank 21. A fibrous tube kerosene wick 25 with a wick-holding metal-ring 24 mounted thereto is provided on the inner side of the wick outer-cylinder 23. The kerosene wick 25 serves to suck up and evaporate the kerosene stored in the fixed tank 21. A wick guiding cylinder 26 is provided on the inner side of the kerosene wick 25 for slidably guiding the kerosene wick 25 from the bottom of the fixed tank to the top end of the kerosene wick 25. At the top end face of the wick guiding cylinder 26 is integrally provided a inner flame plate 27 for forming a frame on the top end of the kerosene wick 25. A chimney which is composed of a red-heat cylinder 30 and an inner flame cylinder 31 is placed on the wick outer-cylinder 23 and the inner flame plate 27 of the wick guiding cylinder 26. The red-heat cylinder 30 and inner flame cylinder 31 of which are respectively perforated with small holes 30*a* and 31*a* constitute as one unit a combustion chamber 32 positioned over the top end of the kerosene wick 25. A radiating net 29 is detachably mounted to cover the combustion chamber 32 on the outer cylinder 28 which is provided at the outside of the red-heat cylinder 30. An oxygen sensor 13 to be employed in the present invention is provided above the radiating net 29 so as to face the upper opening of the combustion chamber and in a position where the air excess ratio of the "rear flow" of the flame to be generated within the combustion chamber by the top end of the kerosene wick 25 is detected. The output of the oxygen sensor 13 is connected through the electronic circuit 33 with a solenoid 34 which is adapted to control the positioning of the top end of the kerosene wick 25. A lever 36, which is adapted to move the kerosene wick 25 vertically along the wick guide cylinder 26, is actuated to operatively cooperate with the plunger 35 of the solenoid 34, which may also operatively cooperate with an earthquake-proof fire extinguishing device of conventional design provided on the appliance.

The operation of the petroleum stove will be described hereinafter.

Figure 7:
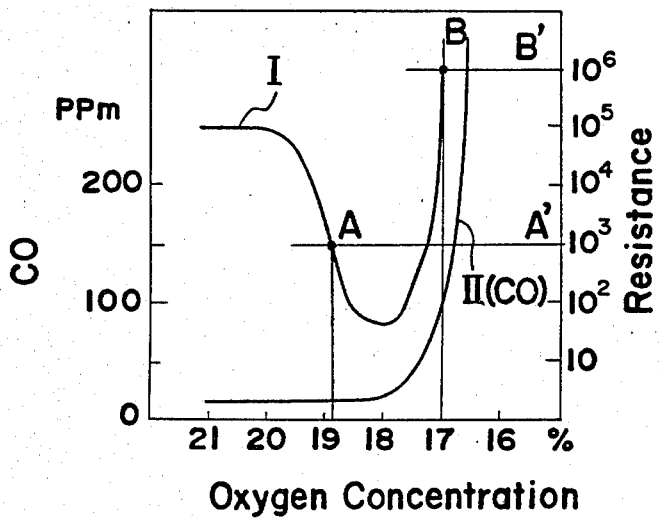
FIG. 7 is a graph showing an oxygen depression characteristic of the apparatus of FIG. 6.

According to the normal burning operation, an igniting operation to the top end of the kerosene wick 25 is performed by a conventional igniting device (not shown) to establish a flame around small holes 30*a* and 31*a* provided on the respective lower portions of the inner flame cylinder 31 and the red-heat cylinder 30, thereby to promote the evaporation of kerosene from the top end of the kerosene wick 25. The flames F1 firstly spread to the small holes in the entire upper portions of the inner flame cylinder 31 and the red-heat cylinder 30 to form the outer flames F2 on the radiating net 29 located on the upper end of the combustion chamber 32. As a result, the combustion is performed with a given amount of kerosene vapor, and the red-heat cylinder 30, the inner flame cylinder 31 and the radiating net 29 become red-hot. Assume that the oxygen concentration in the air is reduced due to some causes, for instance, the clogging of the upper small holes 30*a* and 31*a* with dust or the like, and the port combustion on the inner flame plate 27, i.e., at the lower small holes 30*a* and 31*a*, flickers to go out, the quantity of heat the kerosene wick 25 receives is reduced to control the evaporation, thereby to decrease the amount of kerosene vapor to be combusted. Thus, the outer flames F2 formed on the radiating net 29 vibrate vertically and, thereafter the flames are going to be extinguished from the upper portions thereof, thus producing a lot of carbon monoxide due to the reduced flame temperatures. The graph lines identified by reference characters I and II of FIG. 7 show the relationships between the resistance detected by the oxygen sensor and the oxygen concentration in the air, and between the carbon monoxide production in the combustion chamber and the oxygen concentration, respectively. Since when such oxygen depression as described hereinabove has been caused, the oxygen sensor 13 senses vibration of the outer flames, as apparent from the relationship between the I and II of FIG. 7, the resistance lowers before a lot of carbon monoxide is produced. Thus, assume that a proper detecting level such as level A—A' of FIG. 7, at which the resistance becomes suddenly lower before producing the large amount of the carbon monoxide, is determined for the purpose of detecting the oxygen depression, and the oxygen sensor 13 is set to detect the level for the oxygen depression condition. Then at that level, the electronic circuit 33 will move the plunger 35 of the solenoid 34 to lower the kerosene wick 25 through the lever 36 to extinguish the combustion.

When the vibration of the outer flames F2 caused during the oxygen depression is small, the oxygen sensor 13 will not detect the vibration. In this condition, it might be feared that the oxygen sensor 13 does not operate to detect the oxygen depression. However, as the oxygen concentration becomes lower, the flames are going to be removed from the red-heat portion of the radiating net 29, and the temperature of the red-heat portion lowers greatly to allow the oxygen sensor 13 to detect the oxygen depression condition. Namely, the oxygen sensor used here, which has thermistor-characteristics, is disposed above the radiating net 29 in the atmosphere of high temperatures between 600° and 900° C. Accordingly, when the oxygen concentration is reduced as described hereinabove to reduce the amount of combustion and the flames disappear from the upper portion of the red-heat cylinder 30 to lower the temperature of the latter, the resistance value of the oxygen sensor 13 becomes extremely large to the extent of 1

MΩ or more and such large changes in resistance value such as a level of B—B' in FIG. 7 are sensed and the kerosene wick 25 is lowered, as described hereinabove, by the electronic circuit 33 and solenoid 34 to extinguish the combustor. In this manner the petroleum stove of the present invention can operate in a doubly safe manner. In the combustor, the oxygen sensor 13 is provided above the red-heat portion of the red-heat cylinder 30 to detect the temperature changes caused by the oxygen depression which are sure to appear in the arrangement of the present invention. Referring to FIG. 7, the resistance of the oxygen sensor 13 is lower when the oxygen concentration is approximately 19%, since the oxygen sensor is located in the flames and the oxygen depression has been detected, while the resistance of the oxygen sensor is higher when the oxygen concentration is approximately 17%, since the amount of combustion in the combustor is reduced to partially remove the flames, thereby to lower the temperature of the oxygen sensor.

The resistance value of the oxygen sensor 13 which is adapted to detect the air excess through the flame "rear flow" becomes abnormal even when the supply of the combustion air has been prevented due to dust or the like, thereby to extinguish the combustor by the same operations as those during the oxygen depression.

The oxygen sensor used in the appliance of the present invention is made of a transition metal oxide such as $TiO_2$ or the like. A tin oxide or the like which shows the same characteristics as the transition metal oxide, or oxides which show the characteristics opposite in resistance characteristics with respect to the mixture ratio, i.e., show the characteristics wherein the resistance value is lower when the amount of air is more than the theoretical amount, and is higher when the amount of air is less than the theoretical amount, may be used for the oxygen sensor.

As described hereinabove, according to the present invention, a red-heat cylinder composed of wire gauze, punching plate, lath wire, etc. is provided on the outer side of an inner flame cylinder with a plurality of small holes therein, while an outer cylinder is provided on the outer side of the red-heat cylinder and inner flame cylinder and a fuel supplying means is provided between the inner flame cylinder the red-heat cylinder, and an oxygen sensor is disposed in a position where the air excess ratio of the flames can be detected in the combustion flame "rear-flow" and a means for cutting off the fuel feed means, which operates in response to the output of the oxygen sensor is also provided. The combustion appliance with the safety device of the present invention can detect without failure abnormal flames to cut off the supply of the fuel before carbon monoxide is produced by incomplete combustion caused by decreased oxygen concentration in the air or reduction in the amount of air required for combustion. Thus, problems do not remain unsettled in terms of safety as in the conventional oxygen depression safety device. Also, the safety device can be combined with an extinguisher or the like as in the conventional petroleum combustion appliance, to easily add an oxygen depression safety device to in the conventional device.

Although the present invention has been described and illustrated in detail, it is clearly understood that the same is by way of illustration and examples and is not to be taken by way of limitation, the scope of the present invention being limited only by the terms of the appended claims.

What is claimed is:

1. A combustion appliance with a safety device therein, comprising a combustor composed of an inner flame cylinder with a plurality of small holes therein, a red-heat cylinder disposed on the outer side of said inner flame cylinder, an outer cylinder disposed on the outer side of said red-heat cylinder, and means for supplying combustable fuel between the inner flame cylinder and the red-heat cylinder, an oxygen sensor disposed in the flame rear flow of said combustor and in a position where the air excess ratio of said flames varies substantially depending on the amount of air available to combust fuel from said fuel supplying means, and a fuel feed cutting-off means for cutting off fuel supplied by said fuel supplying means with the output of said oxygen sensor, said oxygen sensor comprising a partial oxygen pressure sensitive oxygen sensor having a pair of spaced electrodes, the resistance between which varies with the partial oxygen pressure being detected.

2. A combustion appliance with a safety device therein as in claim 1, wherein said oxygen sensor is disposed approximately above the red-heat cylinder of said combustor and in a position where the radiated heat of the red-heat cylinder can be received.

3. A combustion appliance with a safety device therein as in claim 1, wherein the oxygen comprises a transition metal oxide.

4. A combustion appliance with a safety device therein in accordance with claim 1 or 2, wherein the outer cylinder is composed of a heat-resisting heat-transmission material.

5. A combustion appliance as in claim 3, wherein said transition metal oxide is selected from the group of transition metal oxides consisting of $TiO_2$, $V_2O_5$, $Cr_2O_3$, $SnO_2$, $Fe_2O_3$, NiO, CoO, $CeO_2$, $Pr_6O_{11}$, and $SnO_2$.

* * * * *